US005284127A

United States Patent [19]

Driesmans

[11] Patent Number: 5,284,127

[45] Date of Patent: Feb. 8, 1994

[54] DEVICE FOR REGULATING THE STRENGTH OF THE FLUE DRAUGHT IN HEATING APPLIANCES

[75] Inventor: Jean Driesmans, Linden/Lubbeek, Belgium

[73] Assignee: V.F.M. Verkoop en Fabrikatie van Metaalprodukten Naamloze Vennootschap, Belgium

[21] Appl. No.: 976,014

[22] Filed: Nov. 13, 1992

[30] Foreign Application Priority Data

Nov. 14, 1991 [BE] Belgium ..... 09101044

[51] Int. Cl.[5] ..... F24C 1/14

[52] U.S. Cl. ..... 126/77; 126/515; 126/193

[58] Field of Search ..... 126/77, 515, 518, 290, 126/193, 200, 198, 190

[56] References Cited

U.S. PATENT DOCUMENTS

| | | | |
|---|---|---|---|
| 2,948,276 | 8/1960 | Harding | 126/77 X |
| 4,141,336 | 2/1979 | Fitch . | |
| 4,180,051 | 12/1979 | Maier et al. | 126/193 X |
| 4,404,953 | 9/1983 | Thulman et al. | 126/193 X |
| 4,530,346 | 7/1985 | Roy | 126/77 |
| 4,580,546 | 4/1986 | Barnett | 126/77 X |
| 4,651,709 | 3/1987 | Schnetker | 126/193 X |

*Primary Examiner*—Larry Jones
*Attorney, Agent, or Firm*—William A. Drucker

[57] ABSTRACT

An air guide element is installed between air supply vent and the inside of the door of the heating appliance which consists of an adjustable damper for regulating the supply of secondary combustion air and ballast air in the appliance and in which at least one heat sensitive element is connected between said damper and one of the components of the heating appliance which serves to adjust said damper, which element reacts to the prevailing temperature in the combustion chamber of the appliance.

6 Claims, 2 Drawing Sheets

DEVICE FOR REGULATING THE STRENGTH OF THE FLUE DRAUGHT IN HEATING APPLIANCES

BACKGROUND OF THE INVENTION

1. Field of the Invention

The invention is for a device which makes it possible to regulate automatically the strength of the flue draught of a heating appliance connected to a flue. Such a heating appliance may consist of a furnace for burning solid fuels, a stove, a built-in appliance, a central heating boiler or a baker's oven.

2. Brief Description of the Prior Art

A device is known from E.P. Patent no. 94455 of applicant which is applied in a heating appliance with a glazed door in which a secondary air supply vent is provided between the door and the fuel grille for the supply of secondary combustion air and inside the appliance an air guide element is fastened between the air supply vent and the inside of the glass door for directing the supply of secondary combustion air against the inside of the door and towards the top of the combustion chamber.

It is, however, not possible with this device to regulate the flue draught in the appliance automatically with the aim of always supplying the required volume of secondary and ballast air with the occurrence of every negative influence in the appliance, and in this way correcting the draught in the flue.

SUMMARY OF THE INVENTION

In order to remedy this, a device has, according to the foremost characteristic of the invention, been implemented whereby the air guide element consists of an elongated adjustable damper for controlling the supply of secondary and ballast air in the appliance and where at least one heat sensitive element is connected between said damper and one of the components of the heating appliance for moving said damper, which element reacts to the temperature prevailing in the combustion chamber of the apparatus.

The heat sensitive element may be any element whatsoever which sets the damper to the suitable position, such as for example a bimetallic strip or rod, a memory system or gas expansion system. This position is determined automatically by the temperature difference which arises in the combustion space of the heating appliance. As a result it is possible to obtain the most suitable combustion temperature in the heating appliance at all times.

Because the supplied secondary air and ballast air is directed against the inside of the door and upwards in the combustion chamber and the supply is always regulated in relation to the suitable combustion temperature in the heating apparatus, the inside of the door is always kept free of all wastes, such as tar and soot. Likewise all moisture due to condensation in the flue gas channel of the heating device is avoided and this flue gas channel dries better and more quickly, including the coldest and/or wettest end of the flue gas channel. In this way all fouling of the flue gas channel is avoided after the addition of fuel to the heating device upon each cold start or when refiring the appliance, even when 50% wet wood is used, thus eliminating any likelihood of chimney fires. Other advantages are that visible patches of water, soot, tar, mould or condensation on the outside of the flue gas channel are avoided and that as a result of the self-cleansing action of the heating appliance it does not become dirty. Furthermore greater heat output is obtained by the preciser oxygen supply in the transition phase from CO to $CO_2$, which is the result of the faster adjustment of the damper. Yet another major advantage is that the flue gases are kept clean regardless of the nature, material or dimensions of the flue or of the associated accessories or other negative factors.

BRIEF DESCRIPTION OF THE DRAWINGS

By way of example, without being in any way exhaustive, a more detailed description of a preferred embodiment of the device in accordance with the invention is given below, where.

DESCRIPTION OF THE PREFERRED EMBODIMENT

Figure 1:
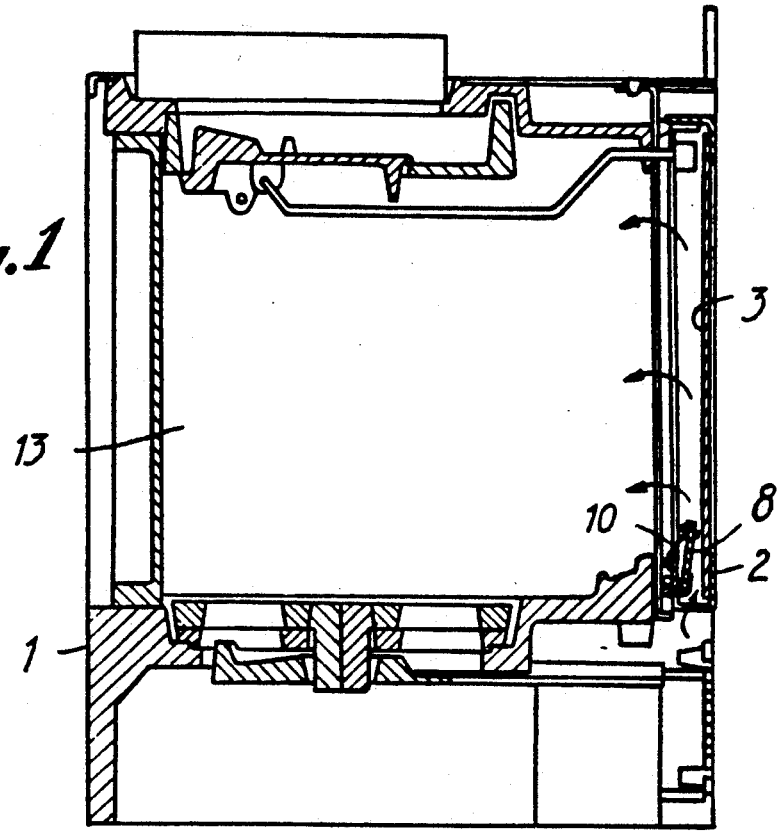
FIG. 1 shows a vertical section through a heating appliance with a regulating device according to the invention.
Figure 2:
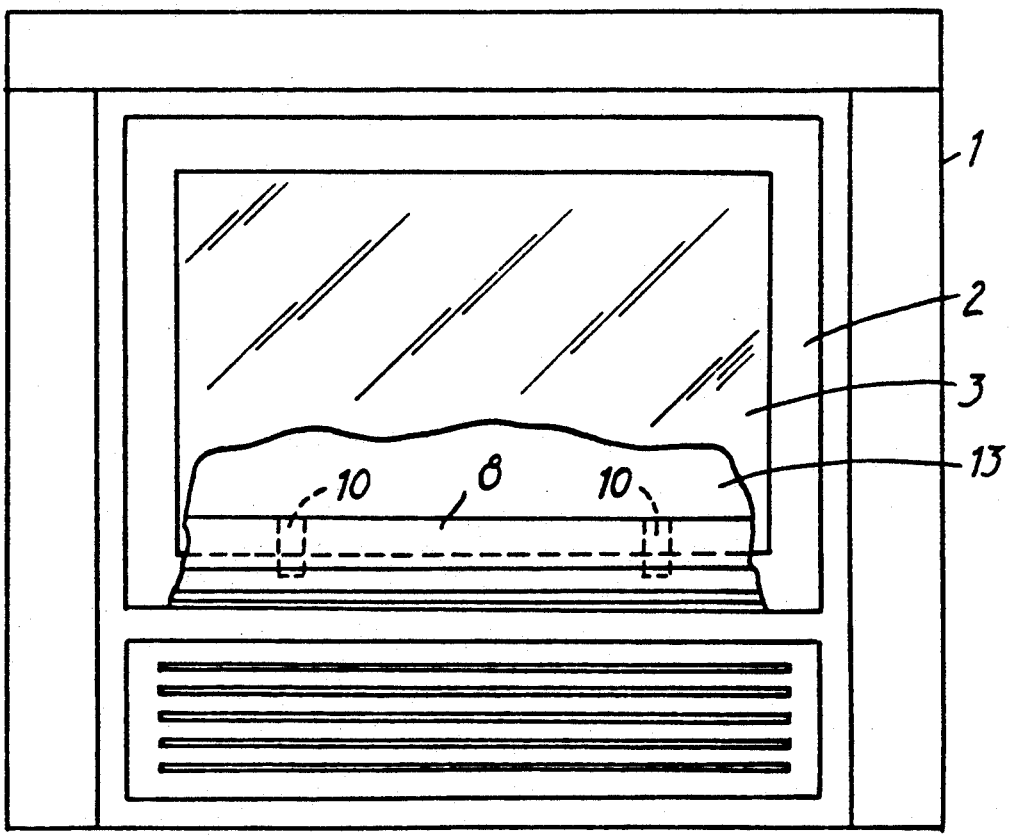
FIG. 2 shows a front elevation of a heating appliance with a partially cut away door.
Figure 3:
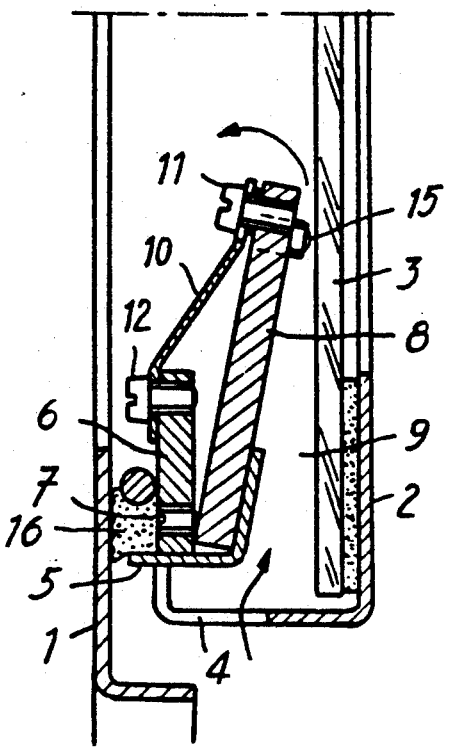
FIGS. 3 and 4 show an enlarged section through the regulating device in two different position.
Figure 5:
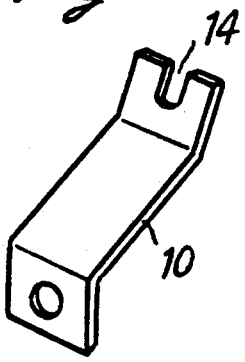
FIG. 5 shows a perspective view of the bimetallic strip used in the regulating device.

In these figures a heating appliance 1 for solid fuels can be seen which is equipped with a door 2 with a glass panel 3. A horizontal slot 4 is provided in the lower edge of door 2 for supplying secondary air and ballast air to the heating apparatus 1. An L-shaped section 5 is fastened at a certain distance from the glass panel 3 in the lower part of door 2, the upright leg of which leans toward the glass panel 3. An upstanding support 6 in which at least one adjusting screw 7 is provided is mounted on the flat leg of this section 5. Between this adjusting screw and the sloping leg of the L-shaped section 5 there is an elongated damper 8 mounted in such a way that the lower edge pivots between the support 6 and the sloping leg of the section 5 and the damper 8 can adjust the supply opening 9 between the section 5 and the glass panel 3. Between the damper 8 and the upright support 6 one or more bimetallic strips 10 are mounted by means of screws 11–12 which strips react to the temperature prevailing in the combustion chamber 13 of the heating apparatus 1. As a result the quantity and speed of the supply of secondary and ballast air can be regulated. The two ends of the bimetallic strips 10 are by preference bent to an angle, so that the middle section slopes at an angle with respect to the two ends. There is a slot 14 provided in the end of the bimetallic strips fastened to the damper, which makes a change in the position between the damper 8 and the bimetallic strips 10 possible during the bending of these bimetallic strips. One or more adjusting screws 15 can be provided in the upper part of the damper which act in conjunction with the glass panel 3 and which prevent the damper 8 from totally closing off the supply of secondary air. Finally the door 2 is provided with sealing strip 16, so that the supply of secondary air and ballast air is only possible via openings 4 and 9 between section 5 and the inner side of the glass panel 3 of door 2.

Figure 4:
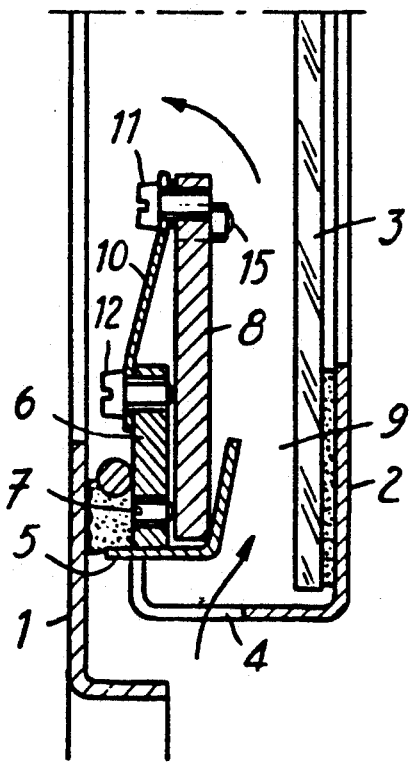

When a fire is prepared in the heating appliance a number of negative factors come into play, such as limited flue draught and low temperature, possible condensation in the flue or moisture in the fuel. In these circumstances the bimetallic strips 10 adapt to the prevailing temperature in the combustion chamber and the damper 8 stand virtually erect in its most open position (FIG. 4). In this position enough secondary air and ballast air flows via the combustion chamber of the heating appliance to the flue channel and the moisture and any condensation in the flue are quickly eliminated. As the fire becomes hotter the bimetallic strips 10 will heat up, with the result that they change their shape and the damper 8 will close the opening 9 to a greater extent. Because the temperature and the draught in the flue have in the meantime increased, enough secondary air will now flow at high speed through the smaller opening 9 into the heating appliance.

During this phase the gases will rotate in the direction opposite to what is usual with conventional combustion. In this process the CO gases released through the grille in the primary combustion phase are sucked in by the fast-flowing air curtain which becomes established against the inside of glass panel 3 of door 2. Here the CO gases become mixed with the incoming secondary air and are drawn downwards via the back panel of the combustion appliance under the influence of the relatively low pressure on the grille resulting from the flue draught. This circulation, which is continuous, causes the CO gases to be burnt to $CO_2$, giving rise to the advantages described above. At the same time the flue gases released into the atmosphere are much cleaner than before.

Damper 8 will always automatically move to the ideal position for the circumstances. For example, when the primary air causes the fire to burn more or less fiercely, damper 8 will close more or less. Likewise, when the heating appliance is refilled with wood which contains more moisture than the previous load, the temperature in the appliance will fall and the damper will move so that it is more open, resulting in a temporary excess of ventilation with ballast air. After refilling with coal, the reduction of the direct radiation from the coal bed will cause the temperature of the bimetallic strips to fall and the damper will move to a more open position so that the heat flow to the flue is enhanced by a temporary excess ventilation of the combustion chamber, which in turn causes the fire to burn more fiercely and automatically reach the ideal temperature. Likewise when the fire is in a stable condition, the inflowing secondary air, will depending on the circumstances be exactly sufficient to achieve extremely good combustion and maximum output.

It goes without saying that the device can be used with any type of air supply vent, installed either below or above the door, in the appliance or in any other place. At the same time it goes without saying that the bimetallic strips can be replaced by any heat sensitive elements whatsoever which serve the purpose and that the shape, the dimensions, number and the mutual location of the parts described above may differ yet still fall within the scope of this invention.

I claim:

1. Device for regulating the flue draught strength in heating appliances, comprising a grille, a door, an air supply vent provided in the heating appliance between said door and the grille of the appliance and for the supply of secondary combustion air and ballast air, an adjustable damper installed inside the appliance between the air supply vent and the inside of the door for regulating the supply of secondary combustion air and ballast air and directing the supplied secondary combustion air and ballast air against the inside of the door and towards the top of the combustion chamber, and at least one heat sensitive element connected between said damper and one of the parts of the heating appliance, for the adjustment of said damper, which element reacts to the prevailing temperature in the combustion chamber of the heating appliance.

2. Device as defined in claim 1, in which the lower edge of the damper is pivotally mounted and the upper edge of the damper is movable towards the inside of the door.

3. Device as defined in claim 1, in which the heat sensitive element consists of at least one bimetallic strip.

4. Device as defined in claim 1, in which the lower side of the door is provided with an air supply vent, inside the door and against its lower edge an elongated section is installed in which the lower side of the damper is pivotally mounted and two bimetallic strips are mounted between the heating appliance and the damper.

5. Device as defined in claim 4, in which the elongated section is L shaped, the upright leg of said section leans towards the inside of the door, an upright support with an adjusting screw is mounted on the horizontal leg of said section, and between said screw and the upright leg the lower end of the damper is pivotally mounted.

6. Device as defined in claim 3, in which both ends of the bimetallic strip are bent to an angle with respect to the central part of the strip.

* * * * *